US005323903A

United States Patent [19]

Bush et al.

[11] Patent Number: 5,323,903

[45] Date of Patent: Jun. 28, 1994

[54] PORTABLE CONTAINER SECURITY DEVICE

[75] Inventors: Harry Bush, 1900 Ridgemoor Lake Ct., Town and Country, Mo. 63131; Mark L. Dickhaus, St. Louis, Mo.

[73] Assignee: Harry Bush, Town and Country, Mo.

[21] Appl. No.: 149,480

[22] Filed: Nov. 9, 1993

Related U.S. Application Data

[63] Continuation-in-part of Ser. No. 977,805, Nov. 17, 1992, which is a continuation-in-part of Ser. No. 865,819, Apr. 1, 1992, abandoned, which is a continuation of Ser. No. 644,950, Jan. 23, 1989, Pat. No. 5,020,667.

[51] Int. Cl.[5] ..... B65D 19/00

[52] U.S. Cl. ..... 206/386; 206/597; 220/1.5; 220/571

[58] Field of Search ..... 206/386, 451, 597; 220/1.5, 23.83, 571; 108/55.1, 55.5

[56] References Cited

U.S. PATENT DOCUMENTS

| | | | |
|---|---|---|---|
| 2,197,598 | 4/1940 | Way | 206/451 |
| 2,692,064 | 10/1954 | Koester | 108/55.1 |
| 2,696,360 | 12/1954 | Toffolon | 206/597 |
| 3,173,539 | 3/1965 | Looker | 206/597 |
| 4,165,024 | 8/1979 | Oswalt et al. | 206/386 |
| 4,917,246 | 4/1990 | Edelhoff | 220/1.5 |
| 5,020,667 | 6/1991 | Bush | 108/55.1 |
| 5,036,976 | 8/1991 | Sechler et al. | 206/386 |
| 5,147,039 | 9/1992 | Sechler et al. | 206/386 |
| 5,249,699 | 10/1993 | Williams | 206/386 |

FOREIGN PATENT DOCUMENTS

| | | | |
|---|---|---|---|
| 303264 | 2/1989 | European Pat. Off. | 206/386 |
| 973430 | 11/1982 | U.S.S.R. | 108/55.5 |

OTHER PUBLICATIONS

Water & Waste Digest, "Poly Basin", Mar. 1992.

Product Brochure, "Overflow Basins", Mar. 1992.

*Primary Examiner*—David T. Fidei

*Attorney, Agent, or Firm*—Polster, Lieder, Woodruff & Lucchesi

[57] ABSTRACT

A device for securing a hazardous material container on a containment assembly includes four corner brackets and four adjustable straps. Each of the corner brackets are removably mounted to a corner of the containment assembly. Each bracket has a hole formed therein. The first adjustable strap is attached to one corner of the material container and extends down through the hole in the first bracket and up to the opposite corner of the container. The second strap is likewise attached to a second corner of the container, extends down through a hole in the second corner bracket and is secured to an opposite corner. The third and fourth straps are similarly attached. The tension on the straps is adjustable to hold the container securely on the containment assembly.

20 Claims, 3 Drawing Sheets

PORTABLE CONTAINER SECURITY DEVICE

BACKGROUND OF THE INVENTION

This is a continuation-in-part application of Ser. No. 07/977,805 filed Nov. 17, 1992 which is a continuation in part of application Ser. No. 07/865,819 filed Apr. 1, 1992, now abandoned, which is a continuation of Ser. No. 07/644,950 filed Jan. 23, 1989 now U.S. Pat. No. 5,020,667.

This invention relates to a portable containment assembly, more particularly to a system for securing large volume containers containing hazardous material on a large volume portable containment assembly.

Various types of material containment structures are known in the art for supporting heavy material containers. Such containment structures are generally designed as a closed pallet-like structure having passages or the like formed therein to accommodate the insertion of a lifting fork to allow limited movement of the structure from one location to another.

Generally speaking, containment structures intended to accommodate containers filled with hazardous materials are designed with a closed structure or base tray that can contain any material spilled or leaked from the hazardous material container. Original containment systems known to the art were generally metal trays formed from stainless steel or the like having a support structure internal to the tray on which the hazardous material containers were set. These prior art metal devices were expensive to manufacture, heavy, and prone to corrosion or deterioration upon contact with a hazardous material such as hydrochloric acid.

Recently, containment devices fabricated from corrosion resistant material such as plastic have appeared in the art. For example, U.S. Pat. No. 4,930,632 to Eckert et al. provides for a containment tray formed of plastic. This invention accommodates the placement of containers held on conventional wooden pallets or support beams set within the tray portion. U.S. Pat. No. 5,036,796 to Sechler et al. discloses an assembly quite similar to Eckert's design employing platform support members as well as a platform. U.S. Pat. No. 5,147,039 also to Sechler et al. provides a design similar to the previous two patents having the additional feature of a plurality of support legs extending upward from the bottom of the tray.

These prior art designs have notable drawbacks. For example, the Sechler and Eckert designs require the use of cross beams or pallets inside the containment tray. These additional structures significantly reduce the containment volume of the tray thereby limiting the size of the container that should be support thereon. Moreover, pallets made of wood or other similar materials can absorb toxic materials, create disposal problems, and add excess weight to the assembly.

A previous design, assigned to the assignee of the present invention, as disclosed in U.S. Pat. No. 5,020,667, alleviated many of the problems found in other prior art devices. The assembly there disclosed uses a corrosion resistant, pervious fiberglass platform that engages the lip around the perimeter of the tray. Furthermore, columnar supports strategically situated under the pervious platform to add support to the platform. Moreover, the columnar supports have holes formed therein to allow the dispersion of spilled materials within the tray thereby effectively improve the containment volume of the tray.

In general, prior art designs are not intended to provide containment for large volume hazardous material containing units such as large volume Department of Transportation (D.O.T.) containers or D.O.T./IBC container. These specific containers are used to transport or store large volumes of hazardous materials such as acids and other chemicals. These D.O.T. type units generally have dimensions ranging from 42 inches wide by 48 inches in length to 48 inches square with height varying depending upon capacity. These containers can accommodate 185 gallons to 550 gallons of material. Such a container containing 400 gallons of sulfuric acid, for example, can weigh as much as 6,600 pounds.

To accommodate these D.O.T./I.B.C. type bulk containers a unique, high profile containment system which is disclosed in application Ser. No. 07/977,805, also assigned to the assignee of the present invention. The tray or basin component of this unique high profile, high volume design has dimensions of 60" wide by 60" in length by 37" in height creating a internal containment capacity of volume great enough to contain a leak or spill from a D.O.T./I.B.C. bulk storage container.

Just as importantly, the unique ratio of height to width to length, disclosed in co-pending application Ser. No. 07/977,805, solves another problem. In my design, a columnar support is placed in each corner of the tray to support the pervious, corrosion resistant platform at a point under each leg of a 48" by 48" D.O.T. style container. This specific arrangement allows a corner leg of the D.O.T. style container to rest over a columnar support even if the container is placed "cockeyed" or skewed on the pervious platform. This relationship between the D.O.T. style container dimensions and the tray dimensions provides for this specific feature. Thus, the containment tray can accommodate weight up to 10,000 lbs. of concentrated load by dispersing the weight among at least four columnar supports placed under the pervious platform, one each directly under each leg of the D.O.T. type storage unit. This novel improvement in the art allows the storage of such D.O.T./I.B.C. bulk containers on a containment system that will also contain a large volumes spill as well as support up to 10,000 pounds of weight even if a handler places the container on the containment tray out of square. The disclosures of application Ser. No. 07/977,805 and U.S. Pat. No. 5,020,667 are intended to be incorporated herein by reference.

With the advent of larger containers, additional problems have surfaced. For example, it can be desirable to ship bulk containers with spillage protection. Prior art containment devices were limited to the storage of containers. Even when limited to storage activities, the presence of bulk storage containers in earthquake prone areas are a cause for concern. Some states, such as California, require that large volume containers filled with hazardous material be secured to the containment system or tray sufficiently to comply to standard requirements for a seismic four (4) area. The invention disclosed hereinafter solves these problems with relatively low cost construction which provides ease of use and simplified components.

SUMMARY OF THE INVENTION

It is, therefore, a principal object of the present invention to provide a securing device to secure a hazardous material container on a containment system that will comply to standard requirements for a seismic four (4) event.

Another object of the invention is to provide a device for securing a hazardous material container as a containment assembly where the force exerted on the device is less than the force required for failure of the device.

It is still another object of the present invention to provide a security device for securing a hazardous material container in a containment system that will secure the container in the containment system during transportation;

Yet another object of the present invention is to provide a device for securing a D.O.T./IBC bulk storage container on a large volume containment assembly;

Still another object of the present invention is to provide a device for securing a hazardous material container on a containment assembly that can be retrofitted to the containment system;

A still further object of the present invention is to provide a device for securing a hazardous material container to a containment system that includes generally, a plurality of corner brackets and at least one adjustable strap that extends from a top corner of the hazardous material container through a corner bracket and to the opposite top corner of the container.

A further object of the invention is to provide a device for securing a hazardous material container to a spill containment assembly that is simple in construction, economical to manufacture, easy to attach and remove, and well suited for its intended purposes.

In accordance with the invention, briefly stated, a device for securing a hazardous material container to a spill containment device includes, in the preferred embodiment, a plurality of corner brackets, removably mounted to preselected corners of the containment system. Preferably, four of the brackets are employed. Each of the corner brackets is generally constructed as a right angle with each leg of the angle formed from an L-shaped member. The members mount on the lip of the containment system tray. A cross brace member forms the hypotenuse for the legs. The cross brace has an opening formed in it. A first adjustable strap is attached to one top corner of the hazardous material container, extends down and through the hole in a first corner bracket and extends up and is secured to an opposite top corner of the container. A second strap is likewise attached to another top corner of the container and extends through a second corner bracket to an opposite top corner of the container. A third strap is similarly attached, as is a fourth strap. The straps have an adjustment means whereby the tension on the straps can be adjusted to retain the hazardous material container tightly to the containment system.

DESCRIPTION OF THE PREFERRED EMBODIMENT

Figure 1:
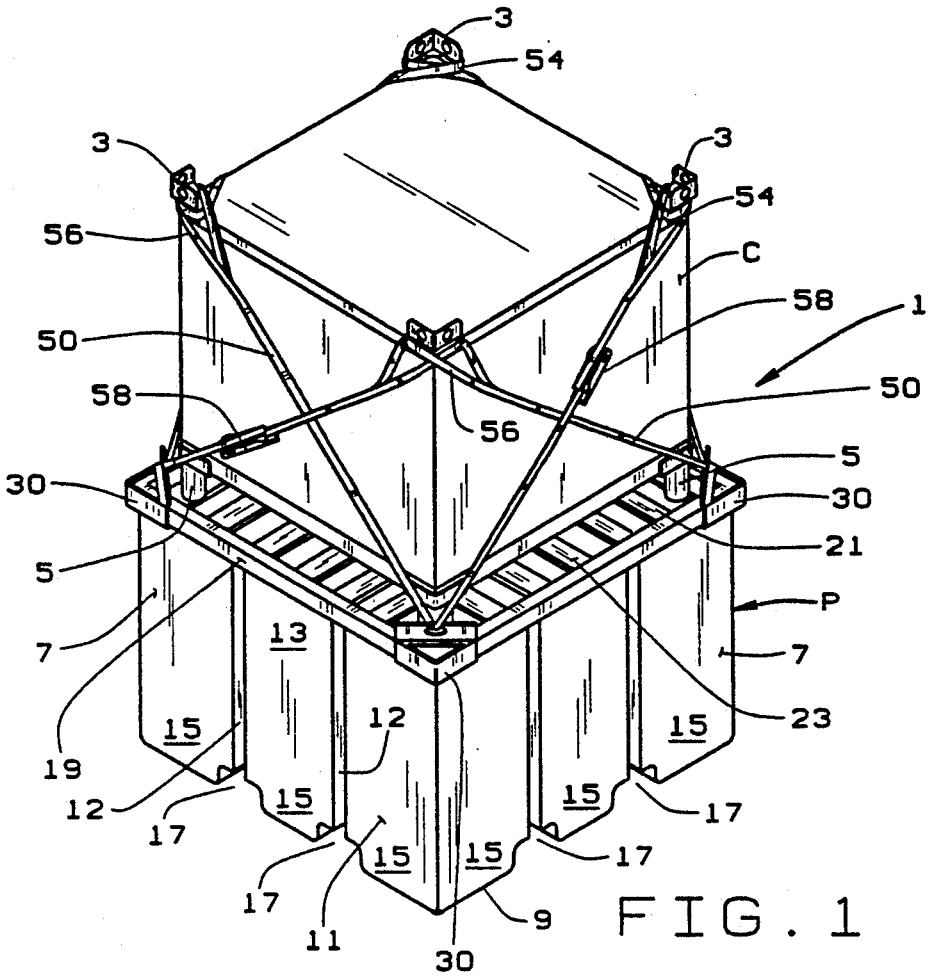
FIG. 1 is a perspective view of a hazardous material container secured to a containment system with the novel security device of the present invention.
Figure 2:
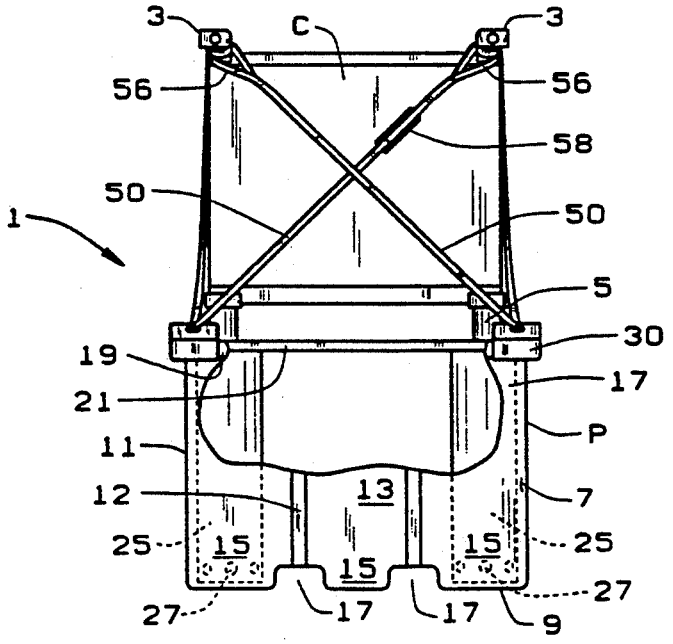
FIG. 2 is a side elevational view, partially cut away, of a hazardous material container secured to a containment system with the novel security device of the present invention.

A security device of the present invention as indicated generally by reference numeral 1 in FIGS. 1 and 2, securing a hazardous material container C to a spill containment assembly P.

Container C, as illustrated, is of a type known to the industry as a D.O.T. type material container unit or D.O.T./I.B.C. (Intermediate Bulk Containment) bulk storage or shipping container. Generally, container C has dimensions of 42 inches in width by 48 inches in length up to 48 inches in width by 48 inches in length. The height of container C varies according to the containment capacity up to approximately 72 inches high. A container C having dimensions of 48 inches in length by 48 inches in width by 72 inches in height can hold up to 550 gallons of material such as bulk chemicals or hazardous liquid material such as hydrochloric acid or sulfuric acid. Container C, when filled with sulfuric acid for example, can weigh as much as 9,000 pounds. However, approximately 80% of all D.O.T./I.B.C. containers in use in the United States have a 300 to 350 gallon capacity.

Container C generally has stacking braces, as at 3, on the top corners. Support legs 5 under each corner of an upper container C engage braces 3 of a lower container C when they are are stacked for storage.

Spill containment system assembly P has a containment tray portion 7 which includes an integral bottom wall member 9 and vertically extending side wall members 11 The wall members 11 have vertical support indentions 12 formed therein so as to provide additional strength and rigidity of the side walls. The side wall member and bottom wall member preferably are formed from corrosion resistant polyethylene material. The bottom wall and side wall members are shaped to define a confined chamber 13. It should be noted that optimal dimensions of tray 7 in the preferred embodiment are approximately 60 inches in length by 60 inches in width as well as approximately 20 to 40 inches in height. These dimensions provide for optimal placement of container C on containment system P as will be described in detail below.

Confined chamber 13 includes a plurality of spaced rows on confined subchamber 15 formed in bottom wall 9 by rows of access passages 17 extending between the subchambers in crossing relation separate from subchambers 15. This arrangement permits insertion of a containment system lifting means, such as a lift fork (not shown) from any one or more of the sides of containment system P thus permitting multiple lift entry.

Chamber 13 is designed to provide a closed containment chamber having a total volume capacity of at least 300 gallons.

Figure 7:
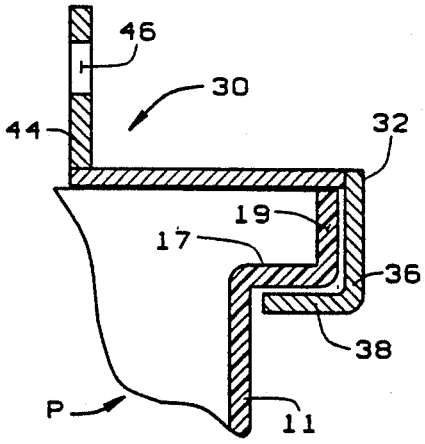
FIG. 7 is a cross sectional view of a corner bracket element of the security device of the present invention mounted on a corner of the tray element of the containment system.

As can be seen in FIG. 7, the side walls 11 define a peripherally extending internal support edge or lip 17 and a vertically extending peripheral skirt 19. Lip 17 serves to support a platform 21 (FIG. 1). Platform 21 is intended to be pervious. Platform 21 preferably is formed from a suitable corrosion resistant fiberglass material, and can be similar to the pervious grating disclosed in my U.S. Pat. No. 5,020,667, the disclosure of which is herein incorporated by reference.

As can be seen in FIG. 2, a removable, supplementary or secondary support is provided for pervious support platform 21. Preferably this secondary support is formed from a suitable corrosion resistant plastic material formed as a cylindrical container or tube 25, and placed within the subchambers 15. Placement in subchamber 15 helps secure tubes 25 in place since they cannot slide or migrate out of subchamber 15. As shown in FIG. 2, tubes 25 are placed within the four corner subchambers 15 so as to provide support to the corners of the pervious platform 21. Other placements are compatible with the broader aspects of this invention. For example, a single tube 25 can be placed in a central subchamber 15, if desired.

Tubes 25 have at least one opening formed in them. In the embodiment illustrated the tubes 25 have a ring of spaced apertures 27 designed to allow spilled material to flow into the tube 25 so as to disperse the spilled material within the chamber 13. The apertures 27 allow construction of supports 25 which do not excessively subtract from the containment capacity of chamber 13 and subchambers 15. It is to be noted that tube 25 is positioned in both height and breadth to provide uniform undersupport for pervious platform 21.

In the preferred embodiment, tubes 25 have an outside diameter of 10¾ inches and are placed in the four corner subchambers 15 as described above, the dimensions of the tray of 60 inches in width by 60 inches in length allow for the placement of tubes 25 so that each leg 5 of a D.O.T./I.B.C. container C measuring 42 inches in width by 48 inches in length or 48 inches in width by 48 inches in length will always rest on pervious platform 21 over a tube 25 even if container C is placed on containment system P in skewed manner. This ratio of sizes between the D.O.T. type transfer container and the containment system P is best illustrated in FIGS. 3 and 4.

Figure 3:
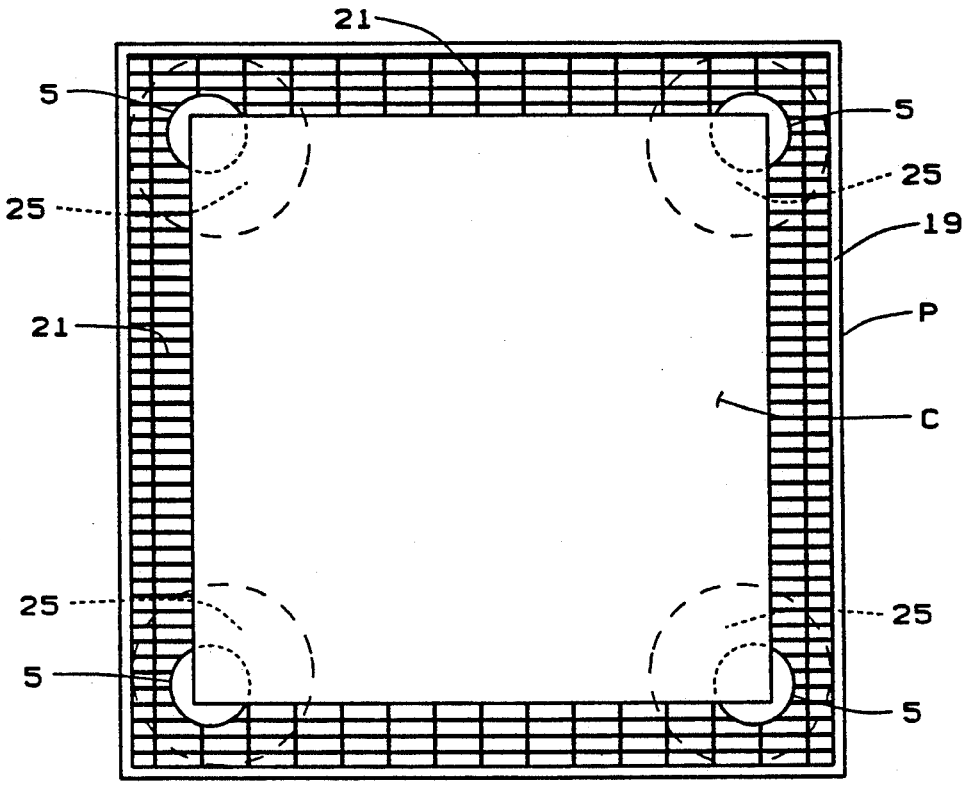
FIG. 3 is a diagrammatic, top plan view of a hazardous material container setting in a squared position on a containment system.
Figure 4:
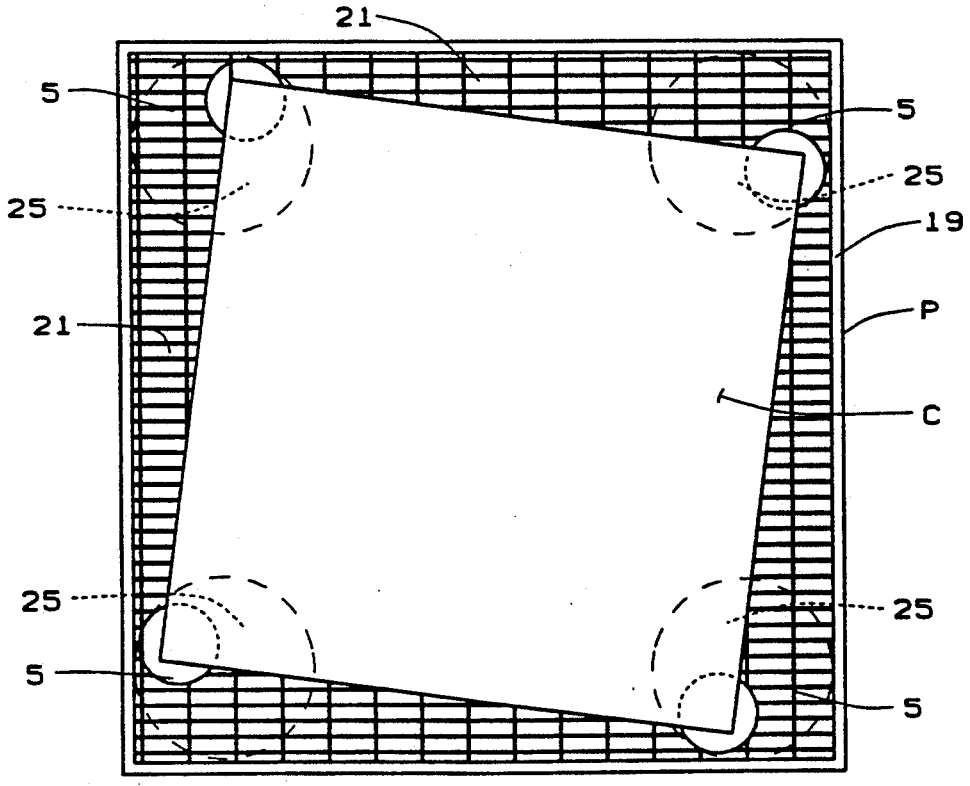
FIG. 4 is a diagrammatic, top plan view of a hazardous material container setting in skewed position on a containment system.

FIG. 3 illustrates a proportionate drawing of a 48 inch long by 48 inch wide container C situated squarely on containment system P having measurements of 60 inches wide by 60 inches in length. Legs 5 rest squarely over tubes 25 which support pervious platform 21. As stated above, tubes 25 have an outside diameter of 10¾ inches with a 7/16 inch thick wall. FIG. 4 shows the relationship of the elements when container C is placed on containment system P in an extremely skewed position. By virtue of the ratio of the sizes between containment system P and container C, legs 5 must remain over tube 25 so as to disperse the container weight evenly over platform 21 and tubes 25.

Figure 5:
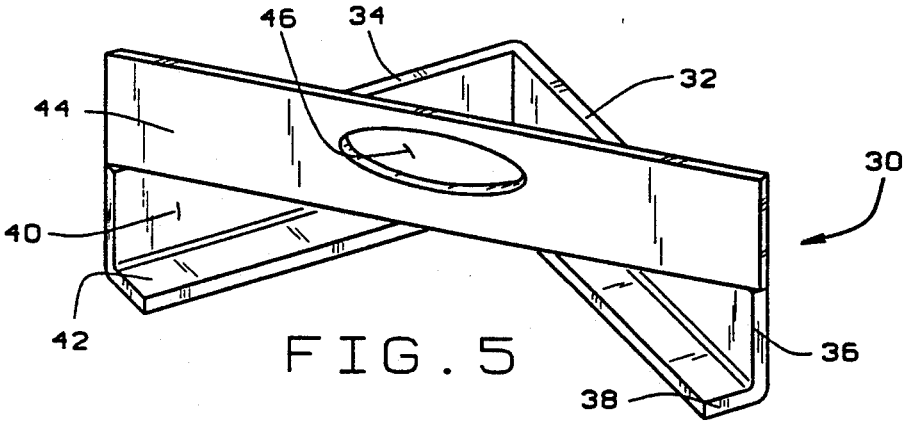
FIG. 5 is a perspective view of a corner bracket element of the security device of the present invention.

Security device 1 is designed to attach container C on containment system P. Device 1 includes a plurality of corner brackets 30, one each of the bracket 30 being mounted on a corner of containment system P. Bracket 30 is shown in greater detail in FIGS. 5 and 7. As thus shown bracket 30 is constructed generally as right triangle in plan, having a first leg 32 and second leg 34. Legs 32 and 34 both have an "L" shape in cross section. Leg 32 has a vertical side portion 34 and a horizontal side portion 38 extending outwardly from it. Likewise, leg 34 has a vertical side portion 40 with a horizontal side portion 42 extending outwardly from it A cross brace 44, forms a hypotenuse of the right triangle, defined by the legs 32, 34 and brace 44. The brace 44 is mounted along a top edge of the vertical side portion of each of the legs 32 and 34. The brace 44 has a hole 46 formed centrally therein. Hole 46 has smoothly rounded edges so as to not damage an associated tie-down 50 which is inserted through hole 46 as will be explained hereinafter.

Each respective bracket 30 is mounted on a corner of container P as illustrated in FIG. 7. Vertical side 36 abuts skirt 19 and horizontal side 38 engages the underside of lip 17, while cross brace 44 acts to hold the bracket 30 in position. This relationship likewise occurs on the opposite side of the corner of containment system P. The engagement of horizontal side portions 38 and 42 under lip 17 prevents the application of an upward force on cross brace 44 of bracket 30 to dislodge the bracket from the corner of the containment system. Since the cross brace 44 is set in at the hypotenuse of the right triangle formed by the bracket 30, the upward pressure exerted on bracket 30 is exerted at a point inward from the extreme corner of the bracket thereby providing additional stability.

Figure 6:
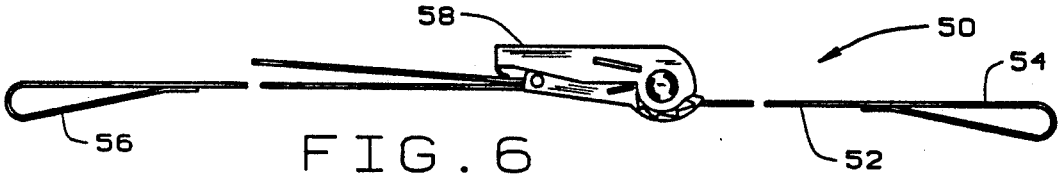
FIG. 6 is a side elevation view of a tie-down element of the security device of the present invention.

The tie-down elements 50 of the present invention are illustrated in detail in FIG. 6. Tie-down 50, as shown, consists of an elongated strap 52 having a first loop 54 formed in one extreme end thereof and second loop 56 formed in the opposite extreme end. In the preferred embodiment, tie-down 50 is generally a flattened strap made from a high tensile strength synthetic fabric such as nylon. It should be noted, however, that the tie-down could be made of nylon or plastic coated cable, a belt, or other appropriate elongated, high tensile strength element without departing from the scope of the invention.

A standard pawl and ratchet type tensioning device 58 is positioned centrally on strap 52. Tensioning device 58 or "come-along" is manipulated when tie-down 50 is in place to increase the tension on the tie-down to secure the load in place.

FIGS. 1 and 2 illustrate the security device 1 in use. A loop 54 of tie-down 50 is placed over a first stacking brace 3 of container C. Strap 52 extends down through hole 46 in a first bracket 30 and extends up so that loop 56 of strap 52 is secured around a brace 3 on a corner opposite to the brace on which loop 54 is secured. A second tie-down 50 is similarly attached to a pair of opposing braces 3 through a second bracket 30. A third tie-down 50 is similarly attached through a third bracket 30 and a fourth tie-down is likewise attached to opposing braces 3 through a fourth bracket 30. The tensioning device 58 on each of the four tie-downs is then adjusted to increase the tension on tie-down 50 to securely hold container C on containment system P. It should also be noted that if desired, only two tie-downs may be employed extending one each from opposing corners of containment system P through a corner bracket 30. The arrangement using only two straps may be sufficient to hold smaller or light weight containers.

Figure 8:
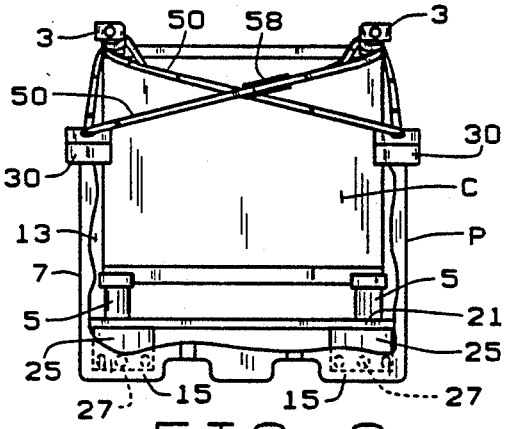
FIG. 8 is a side elevational view, partially cut away, of a hazardous material container secured to an alternative embodiment of a containment system with the security device of the present invention.

FIG. 8 illustrates an alternative arrangement of a D.O.T. type container C within a containment system P. In this arrangement, tubes 25 are placed in each corner subchamber 15 of tray 7. In this embodiment, tubes 25 are substantially shorter than the tubes 25 as illustrated in FIGS. 1 and 2. Pervious platform 21 is undersized sufficiently so as to fit within chamber 13 and rest on tubes 25. Container C rests down within chamber 13 on pervious platform 21. Tie-downs 50 extend from one corner brace 3 down through a hole 46 and a bracket 30 and up to an opposite corner brace as previously described relative to FIGS. 1 and 2. However, the angle of the tie-down 50 formed with respect to the seismic loads is more acute therefore lessening the stress on the strap as will be discussed below. Furthermore, placing the container C deep within chamber 13 lowers the center of gravity and effectively prevents the container from tipping over during transportation or during a seismic event.

Figure 9:
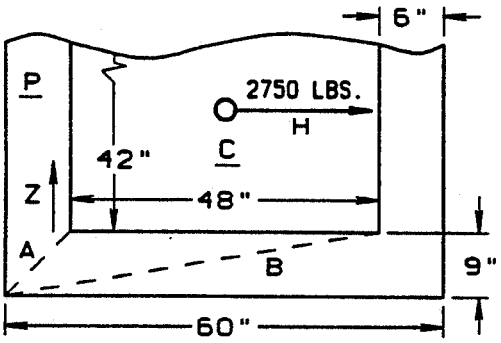
FIG. 9 is a diagrammatic, partial top plan illustrating load forces on the security device of the present invention.
Figure 10:
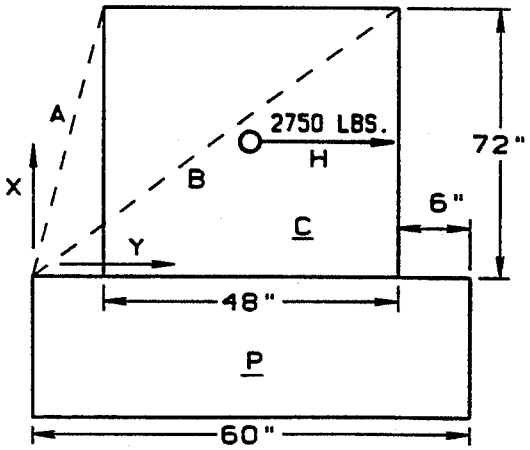
FIG. 10 is a diagrammatic, side elevation also illustrating load forces on the security device of the present invention.

FIGS. 9 and 10 show the load forces on a D.O.T. type container C and illustrate the load reducing effect of the optimal placement of the tie-down 50 on corner braces 3 located on the top corners of the container as provided in the present invention. The following calculations demonstrate the load stress reduction, shown as dotted line B, as realized by attaching the tie-downs strapped to opposite corners rather than extending the tie-down from a corner of the containment system directly up to the corresponding corner of container C, as practiced in the prior art and as illustrated by dotted line A.

In FIGS. 9 and 10, container C is D.O.T. type container measuring approximately 42 inches wide by 48 inches in length by 72 inches in height. These dimension of 42 inches by 48 inches by 72 inches represent a large-load size of a D.O.T./I.B.C. unit carried on a containment system and secured by a device of the present invention. For illustrative purposes, the load stress on the 48 inch side was calculated by using a seismic event load or force of 2750 pounds exerted from the center of container "C" in a horizontal line H. The force required to prevent movement of a container off a containment system P, with the previous art is, coefficient of friction = 0.2:

$$\epsilon F_x = 2750 - \text{fric} - 2A\frac{6}{\sqrt{6^2+9^2+72^2}} = 0$$

$$\epsilon F_y = \text{weight} - \text{reaction} + 2A\frac{72}{\sqrt{6^2+9^2+72^2}} = 0$$

Friction = 0.2 reaction;

$$A = \frac{2750 - (0.2)(2600)}{2\left(\frac{6}{\sqrt{6^2+9^2+72^2}} + \frac{(72)(0.2)}{\sqrt{6^2+9^2+72^2}}\right)} = 3980$$

$$B = \frac{2750 - (0.2)(2600)}{2\left(\frac{54}{\sqrt{6^2+9^2+72^2}} + \frac{72(0.2)}{\sqrt{6^2+9^2+72^2}}\right)} = 1474$$

The overturning forces generated by a seismic event would create a 2750 pound force acting at the center of the container As shown in as line A, this would result in 3980 pound tension force on the tie-down if the tie-down was attached from the corner of the containment system P to the nearest corner of the container C in a near vertical arrangement. If the strap was attached to the corner of containment system P to the far corner of container C, the resulting force on the strap on the 48 inch side would be 1474 pounds.

The 1474 pounds of force, acting as a vector would be divided into three (3) component forces on the corner of containment system P. The component forces would be 1173 pounds acting in the vertical direction (arrow X), 880 pounds acting in the horizontal direction parallel to one edge of containment system P, (arrow y) and 147 pounds is the horizontal direction parallel with the other top edge of containment system (arrow 2), based upon the following equations:.

$$X\text{ Load} = 1474 \times \frac{72}{(72^2+9^2+(48+6)^2)^{\frac{1}{2}}} = 1173\#$$

$$Y\text{ Load} = 1474 \times \frac{48+6}{(72^2+9^2+(48+6)^2)^{\frac{1}{2}}} = 880\#$$

$$Z\text{ Load} = 1474 \times \frac{9}{(72^2+9^2+(48+6)^2)^{\frac{1}{2}}} = 147\#$$

Therefore the effective force on a strap placed at line B would be 1472 pound whereas a strap placed in line A would incur force of 3980 pounds. By running the straps at a more acute angle from the brace 3 through bracket 30 up to an opposite corner brace 3, the restraining capabilities of the strap are improved as well as the reliability and functional life of the containment system.

Moreover, as illustrated by FIGS. 9 and 10 and the related calculations, a reduction in the vertical height of container C will effectively reduce the load stress on a strap placed to position B. For example, placing container C within chamber 13 of containment system P as shown in FIG. 7 could effectively reduce the load on a strap placed at position B assuming that the container C is 72 inches in height and only 36 inches of container C extend above containment system P, the effective load on the strap placed at position B would be as follows:

$$B = \frac{2750 - (0.2)(2600)}{2\left(\frac{54}{\sqrt{36^2+9^2+54^2}} + \frac{36(0.2)}{\sqrt{36^2+9^2+54^2}}\right)} = 1194$$

The more acute the angle of the strap the less load force is exerted on the strap. Therefore, the force exerted on the strap and bracket during any movement is less than the force required for failure of the bracket and strap assembly.

Numerous variations, within the scope of the appended claims will occur to those skilled in the art. As indicated, the number and arrangement of block and straps may vary. Materials used for the components may be altered. Likewise variations in strap material or tightening devices may be made, if desired. While the cross brace member is described as including an opening, the opening may be eliminated in other embodiments of the invention. These variations are merely illustrative. The foregoing description and illustration thus are intended to be illustrative and are not intended to be construed in a limiting sense.

I claim:

1. A device for securing a container to a containment tray comprising:

at least one means for attaching a tie-down removably attached to a corner of the containment tray; and at least one adjustable tie-down removably attached to a corner of the container and extending through said attachment means and then attached to a second corner of the container wherein a maximum expected force exerted on said attachment means and said tie-down is less than the force required for failure of said attachment means and said tie-down.

2. A device for securing a container to a containment assembly having a containment tray comprising:

means for securing the container to the containment assembly wherein the force exerted on the means is less than the force required for failure of said means, said means further comprising a first corner bracket removably mounted on a first corner of a containment tray;

a second corner bracket removably mounted on a second corner of the containment tray;

a third corner bracket removably mounted on a third corner of the containment tray;

a fourth corner bracket removably mounted on a fourth corner of the containment tray, each of the aforesaid corner brackets having a hole formed therein;

a first tie-down removably attached to a first corner of the container and extending through said hole in said first corner bracket and then attached to a second corner of the container;

a second tie-down connected to a second corner of the container and extending through said hole in said second corner bracket and then attached to the first corner of the container;

a third tie-down attached to a third corner of the container and extending through said hole in said third corner bracket and then attached to a fourth corner of the container; and a fourth tie-down attached to a fourth corner of the container and extending through said hole in said fourth corner bracket and then attached to said third corner of the container.

3. The invention of claim 2 wherein each of said tie-down has a first end and second end, each of said ends having a loop formed therein.

4. The invention of claim 2 wherein said tie-down is a strap.

5. The invention of claim 2 wherein said tie-down is a cable.

6. The invention of claim 2 wherein said tie-down is a belt.

7. The invention of claim 2 wherein each said tie-down is adjustable so as to vary the tension on each tie-down.

8. The invention of claim 2 wherein said corner brackets are formed in the shape of a right triangle.

9. The invention of claim 2 wherein each said corner bracket further comprises:

a first elongated side member formed in an L-shape having a first end and a second end;

a second elongated side member formed in an L-shape having a first end and second end;

said first elongated side member and said second elongated side member being attached in a right angle at each said respective first ends thereof;

a cross member attached between said respective second ends of said side members, said cross member having said hole formed therein to accommodate said tie-down.

10. The invention of claim 9 wherein each said corner bracket is made of stainless steel.

11. The invention of claim 7 wherein each said strap is made of nylon.

12. An apparatus for the secured transportation and storage of a hazardous material container comprising:

a containment system on which such hazardous material container rests, said containment system having a containment tray of a liquid impervious unitary construction with at least one side wall integrally formed with a bottom wall and extending upwardly therefrom, said bottom wall being formed with upward indentation means for creating at least one pair of spaced, parallel excess passages for the insertion of a containment system lifting fork means, said containment tray having such dimension so as to create an internal chamber having a volume of at least 300 gallons;

said upward indentions also creating a plurality of spaced, bottom subchambers within said containment system; a pervious platform means for supporting the hazardous material container;

at least one platform support means within said subchamber for supporting said platform means above at least said bottom wall;

a first corner bracket removably mounted on a first corner of the tray;

a second corner bracket removably mounted on a second corner of the containment systems;

a third corner bracket removably mounted on a third corner of the tray;

a fourth corner bracket removably mounted on a fourth corner of said tray, each of the aforesaid corner brackets having a tie-down access hole formed therein;

a first tie-down removably attached to a first corner of the container and extending through said hole in said first corner bracket and then attached to a second corner of the container;

a second tie-down connected to a second corner of the container and extending through said hole and said second corner bracket and then attached the first corner of the container;

a third tie-down attached to a third corner of the container and extending through said hole in said third corner bracket and then attached to a fourth corner of the container; and a fourth tie-down attached to a fourth corner of the container and extending through said hole in said fourth corner bracket and then attached to said third corner of the container.

13. The invention of claim 12 wherein the containment tray dimensions are approximately 60 inches wide by 60 inches in length by 37 inches tall.

14. The invention of claim 13 wherein the pervious platform means is a fiberglass grate.

15. The invention of claim 12 wherein said platform support means further comprises columnar support means situated in each said corner of said tray extending from said bottom to said pervious grate.

16. The invention of claim 15 wherein said columnar means have holes formed therein to allow the dispersal of liquid spilled therein.

17. A system for securing a container to a containment tray, the tray and container respectively having a plurality of corners, respective ones of the corners of the containment tray and the corners of the container being generally vertically aligned with respect to one another during operational use of the systems, comprising:

(a) a bracket removably mounted to at least one corner of the containment tray; and (b) a tie-down extending between the bracket and a non-vertically aligned corner of the container at respective angles of attachment such that the angle of attachment with the bracket and the angle of attachment with the corner distributes force applied to the combined container and containment tray combination in a manner that the maximum forces expected for exertion on the bracket and tie-down is less than the force required for failure of one of said tie down and said bracket.

18. The system of claim 17 wherein said tie-down is adjustable.

19. The system of claim 17 wherein said bracket further comprises:

a first elongated side member formed in an L-shape having a first end and a second end;

a second elongated side member formed in an L-shape having a first end and second end;

said first elongated side member and said second elongated side member being attached in a right angle at each said respective first ends thereof;

a cross member attached between said respective second ends of said side members, said cross member having said hole formed therein to accommodate said tie-down.

20. The system of claim 17 wherein said tie-down is a strap.

* * * * *